US008689402B2

(12) United States Patent
Brunnmayr

(10) Patent No.: US 8,689,402 B2
(45) Date of Patent: Apr. 8, 2014

(54) FURNITURE HINGE

(71) Applicant: Julius Blum GmbH, Hochst (AT)

(72) Inventor: Harald Brunnmayr, Horbranz (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/777,461

(22) Filed: Feb. 26, 2013

(65) Prior Publication Data

US 2013/0167323 A1 Jul. 4, 2013

Related U.S. Application Data

(63) Continuation of application No. PCT/AT2011/000354, filed on Aug. 26, 2011.

(30) Foreign Application Priority Data

Aug. 27, 2010 (AT) ..... A 1435/2010

(51) Int. Cl.
*E05F 1/08* (2006.01)

(52) U.S. Cl.
USPC ..... 16/296; 16/286

(58) Field of Classification Search
USPC ..... 16/286, 287, 288, 296, 294, 262, 387, 16/50, 54, 56
See application file for complete search history.

(56) References Cited

U.S. PATENT DOCUMENTS

| | | | | |
|---|---|---|---|---|
| 3,564,643 | A | 2/1971 | Salice | |
| 3,744,086 | A | 7/1973 | Salice et al. | |
| 3,840,936 | A * | 10/1974 | Sato | 16/286 |
| 3,940,828 | A * | 3/1976 | Lautenschlaeger | 16/288 |
| 4,114,237 | A | 9/1978 | Grass | |
| 4,654,930 | A * | 4/1987 | Lautenschlager et al. | 16/288 |
| 4,819,299 | A * | 4/1989 | Holan | 16/278 |
| 5,008,977 | A * | 4/1991 | Lautenschlager et al. | 16/278 |
| 5,022,117 | A | 6/1991 | Lautenschläger et al. | |
| 5,027,474 | A * | 7/1991 | Bowers | 16/297 |
| 5,029,362 | A * | 7/1991 | Prodan | 16/236 |
| 5,355,557 | A * | 10/1994 | Cress et al. | 16/286 |
| 6,125,508 | A * | 10/2000 | Formenti | 16/335 |
| 6,401,298 | B1 * | 6/2002 | Lenz | 16/335 |
| 6,845,544 | B2 | 1/2005 | Hofer | |
| 2003/0093877 | A1 | 5/2003 | Hofer | |
| 2004/0163211 | A1 | 8/2004 | Rucker | |
| 2004/0226139 | A1 * | 11/2004 | Salice | 16/286 |

FOREIGN PATENT DOCUMENTS

| | | |
|---|---|---|
| AT | 5924 | 1/2003 |
| DE | 2 117 828 | 5/1972 |
| DE | 37 25 942 | 2/1989 |
| DE | 39 12 494 | 10/1990 |

(Continued)

OTHER PUBLICATIONS

International Search Report (ISR) issued Dec. 2, 2011 in International (PCT) Application No. PCT/AT2011/000354.

(Continued)

*Primary Examiner* — Chuck Mah
(74) *Attorney, Agent, or Firm* — Wenderoth, Lind & Ponack, L.L.P.

(57) ABSTRACT

A furniture hinge includes at least one control cam and at least one spring. The control cam moves along on the spring in order to produce a closing force and/or opening force. A sliding element is attached to the spring and/or to the control cam. The control cam or the spring moves along on the sliding element.

16 Claims, 10 Drawing Sheets

(56) References Cited

FOREIGN PATENT DOCUMENTS

| | | | |
|---|---|---|---|
| DE | 203 19 535 | | 3/2004 |
| EP | 1 048 809 | | 11/2000 |
| JP | 2008038459 A | * | 2/2008 |
| JP | 2009264588 A | * | 11/2009 |

OTHER PUBLICATIONS

Austrian Patent Office Search Report (ASR) completed May 20, 2011 in Austrian Patent Application No. A 1435/2010.

* cited by examiner

FIG 4
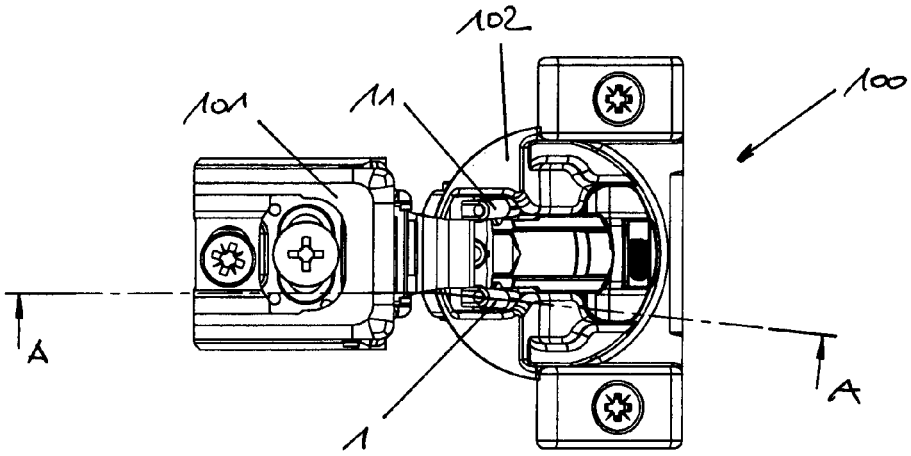
FIG. 5 A-A
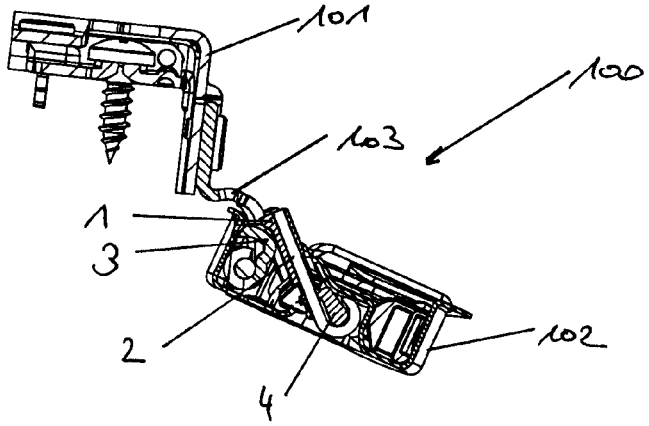
FIG 6
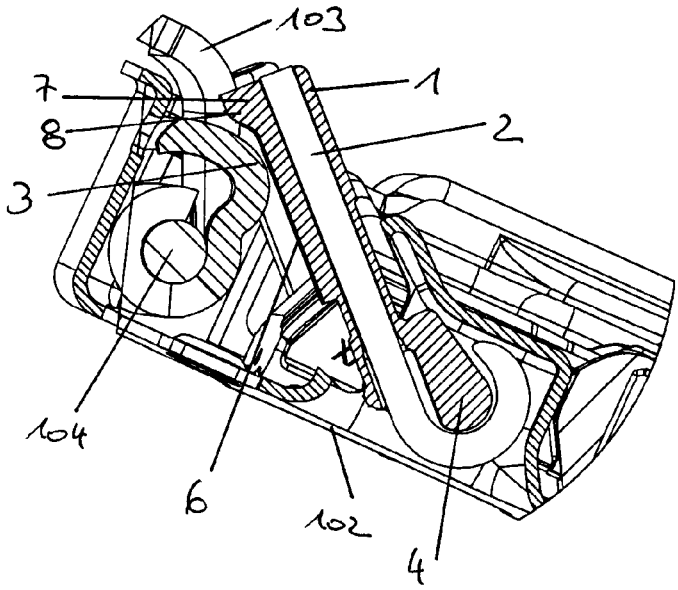

FIG. 9
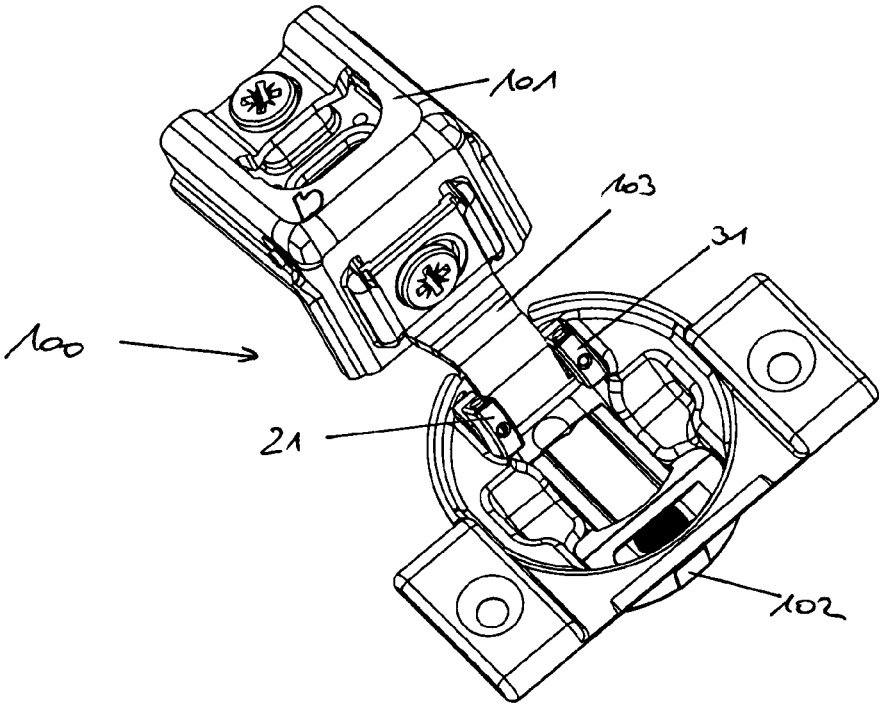
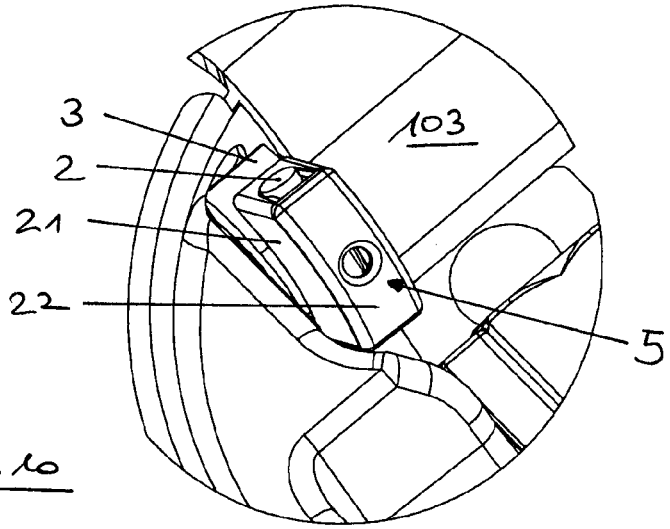
FIG. 10

FURNITURE HINGE

BACKGROUND OF THE INVENTION

The invention relates to a furniture hinge with at least one control cam and at least one spring, wherein the control cam moves along on the spring in order to produce a closing force and/or opening force.

The invention further relates to a piece of furniture with at least one movable furniture part, wherein the furniture part is movably mounted via at least one furniture hinge.

A large number of such furniture hinges are already known from the state of the art. A disadvantage of such furniture hinges is that, because of the high spring load for producing the closing and/or opening force, the spring will break after a certain number of movements of the furniture hinge.

The object of the invention is to avoid the above-described disadvantage and to provide a furniture hinge that improves on the state of the art.

SUMMARY OF THE INVENTION

This object is achieved by a furniture hinge with the features described below.

The use of a sliding element increases the life of the spring, which contributes to a furniture hinge that functions for a longer period of time.

It has proved particularly advantageous if the furniture hinge has a fitting for attachment to a first furniture part and a hinge cup for attachment to a second furniture part. The hinge cup is swivellably connected to the fitting via at least one articulated lever, and the control cam is formed on the articulated lever. The control cam can be formed on the articulated lever with little technical outlay, whereby the costs can be kept low.

According to a preferred embodiment, the sliding element can be pushed onto the spring and/or can be attached to the control cam. The pushing of the sliding element onto the spring can be carried out technically very simply, and so can the attachment to the control cam.

Furthermore, the sliding element can be at least partially—preferably substantially completely—formed from plastic, and/or the spring can be formed from metal—preferably from steel. The sliding element can be formed from plastic technically well and the shaping can preferably be carried out for instance using an injection-molding method. The construction of the spring or springs out of metal can guarantee a long-lasting consistent spring property, and it has been shown that especially the formation from steel can be particularly suitable.

It has proved particularly advantageous if the plastic of the sliding element is formed as a thermoplastic—preferably polyoxymethylene (POM). Thermoplastics can have good rigidity values and good coefficients of friction. In particular, the thermoplastic material polyoxymethylene (POM, also called polyacetal or polyformaldehyde)—because of its high rigidity, its low coefficients of friction and its excellent dimensional stability and also thermal stability—can preferably be used particularly for a precision part such as that of the sliding element.

Preferably, the sliding element can be attached to one end of the spring. The attachment of the sliding element to the spring, especially at its end, can take place simply—such as for instance by being pushed on.

It has proved particularly advantageous if the sliding element has at least one reservoir for a lubricant. By forming a reservoir in the sliding element, the control cam and/or the spring can be supplied with a lubricant that can be introduced into the reservoir.

According to a preferred embodiment, the sliding element has an outer contour differing from the cylinder shape. An outer contour of the sliding element differing from the cylinder shape makes it possible to achieve a larger contact surface for the control cam, whereby point abrasion can be minimized.

It has further proved advantageous that the sliding element has a substantially cylindrical cavity. Through the formation of a substantially cylindrical cavity in the sliding element, the latter can be attached to the spring in a simple way—slid on in this preferred case.

It has proved advantageous if the sliding element has at least one control cam or at least one projection. Due to the formation of a control cam or a projection on the sliding element, the sliding element can also influence the control curve.

It has proved particularly advantageous if the sliding element has a curved plane, and the curved plane is formed substantially straight in a transverse extension and is formed curved in a longitudinal extension. It can thus be achieved that the bearing surface of the sliding element against the spring or against the control cam can be enlarged, whereby point loads can be avoided.

According to a preferred embodiment, the sliding element can have a channel-shaped groove. Due to the formation of a channel-shaped groove in the sliding element, a spring having a circular cross-section can slide in the channel-shaped groove, whereby an enlargement of the bearing surface can likewise result.

Furthermore, the sliding element can be formed as a separate assembly.

Preferably, the sliding element can be formed in one piece. Especially, a one-piece formation of the sliding element can contribute to a simple production process for the sliding element.

According to a possible embodiment, the furniture hinge can have at least two sliding elements. Due to the formation of two sliding elements in the furniture hinge, a symmetrical formation on the furniture hinge can take place, which can contribute to a uniform loading of the furniture hinge during the closing and opening movements.

According to a preferred embodiment, the spring can have a substantially cylindrical cross-section at least at one end. This can likewise contribute to the fact that the sliding element can be slid simply onto the end of the spring, whereby a simple assembly can be achieved.

It has proved particularly advantageous if the spring has a circular cross-section at least in some areas.

Advantageously, the spring can be formed as a leg spring, whereby a constant bending moment can be achieved.

Specifically, protection is also sought for a piece of furniture with at least one movable furniture part. The furniture part is movably mounted via at least one furniture hinge according to at least one of the described embodiments.

BRIEF DESCRIPTION OF THE DRAWINGS

Further details and advantages of the present invention are explained in more detail below with the help of the description of the figures with reference to the embodiments represented in the drawings, in which:

FIG. 4 shows the top view of a furniture hinge, FIG. 5 shows the section through the side view of a furniture hinge as represented in FIG. 4, FIG. 6 is a detail view through the section of the furniture hinge represented in FIG. 5, FIG. 9 shows a further embodiment of a furniture hinge with a sliding element with reservoir in perspective view, FIG. 10 is a detail view from FIG. 9, FIGS. 11*a* and 11*b* are two perspective views of a spring and a sliding element arranged thereon with a reservoir.

DETAILED DESCRIPTION OF THE INVENTION

Figure 1:
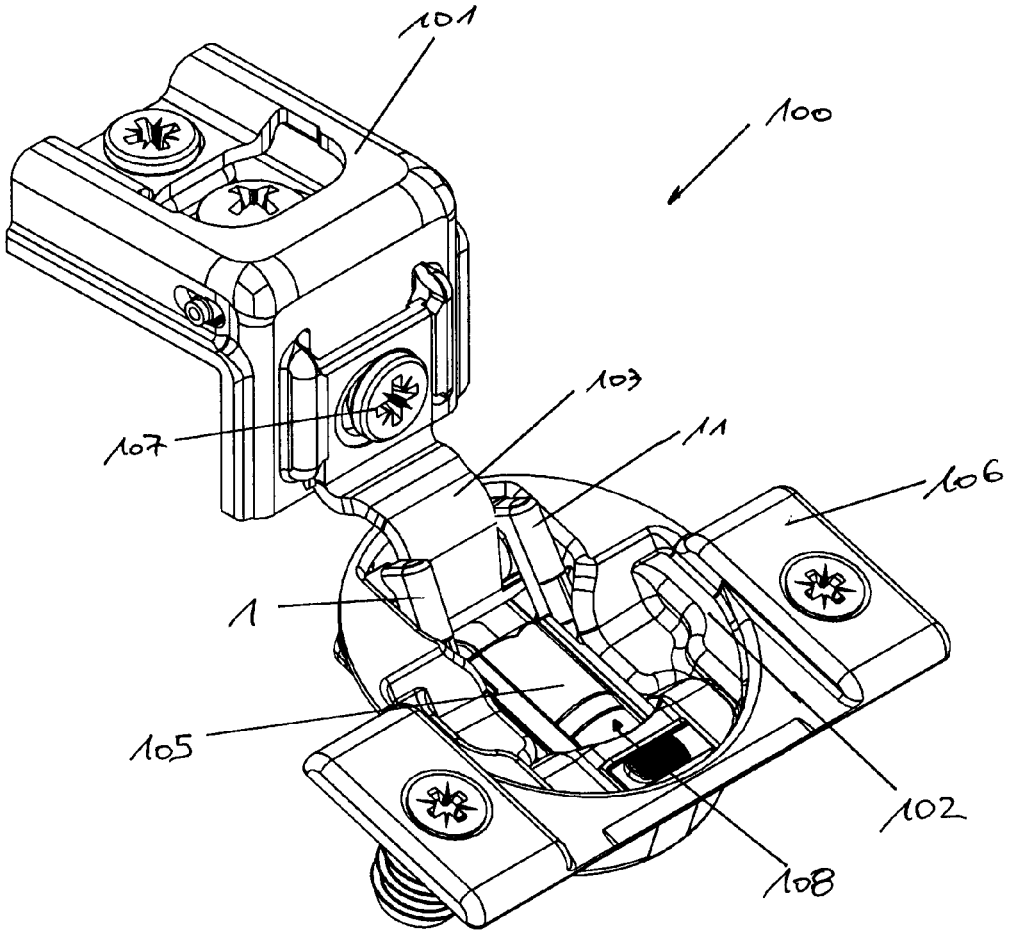
FIG. 1 is a perspective representation of a furniture hinge.

FIG. 1 shows the perspective representation of a furniture hinge 100. This furniture hinge 100 has a fitting 101 for attachment to a first furniture part (not shown), and a hinge cup 102 for attachment to a second furniture part (not shown). The hinge cup 102 is attached to the second furniture part via its attachment flange 106. In this embodiment, an adjustment device 107 is formed on the fitting 101. The fitting 101 is swivellably connected to the hinge cup 102 via an articulated lever 103. An optional damping device 105 with depressible slider, which can damp the closing process of the furniture hinge 100 and thus of the movable furniture part, is arranged in the inner cavity 108 of the hinge cup 102.

In this preferred embodiment, two sliding elements 1 and 11 are arranged above the springs 2 and 12, not visible in this representation. The control cams 3 and 13, not visible here in this figure (see FIG. 2 in this connection), move along on these sliding elements 1 and 11.

Figure 2:
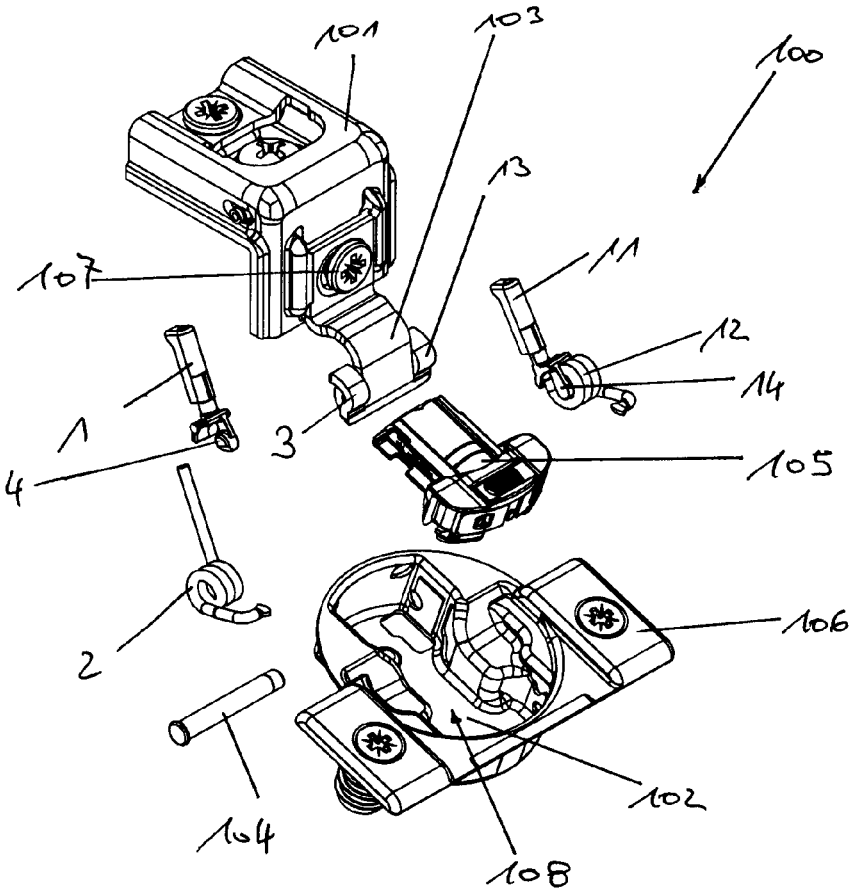
FIG. 2 is a perspective exploded representation of the furniture hinge in FIG. 1, FIGS. 3*a* and 3*b* are two perspective representations of a spring and a sliding element arranged thereon.

FIG. 2 shows a perspective exploded representation of the furniture hinge 100 as represented in FIG. 1. In this embodiment example, the furniture hinge 100 is designed as a single-point hinge, naturally a sliding element is likewise also conceivable and desired for other hinges—such as for instance four-point hinges.

In this especially preferred embodiment, the furniture hinge 100 has the two control cams 3 and 13 on the articulated lever 103, which can be connected on the one hand to hinge cup 102 via the pin 104 and on the other hand to the fitting 101 via the adjustment device 107. In this embodiment, the sliding element 1, preferably formed in one piece, is put on the spring 2, over the spring end. This sliding element 1 preferably has better sliding properties than metal. The attachment device 4, which is preferably formed in the form of a snap connection, can engage in the coils of the spring 2, which is preferably formed as a leg spring, after being put on (see FIGS. 3*a* and 3*b* in this connection), whereby it can be ensured that the sliding element 1 can maintain its position relative to the spring 2. In the assembled state, during the opening and closing process, the sliding element 1 moves along over the control cam 3 of the articulated lever 103.

In this preferred embodiment, the articulated lever 103 has the further control cam 13, and a sliding element 11 is likewise arranged on the control cam 13. This sliding element 11 is—as just described for the sliding element 1—connected to a further spring 12 via its attachment device 14.

Figure 7:
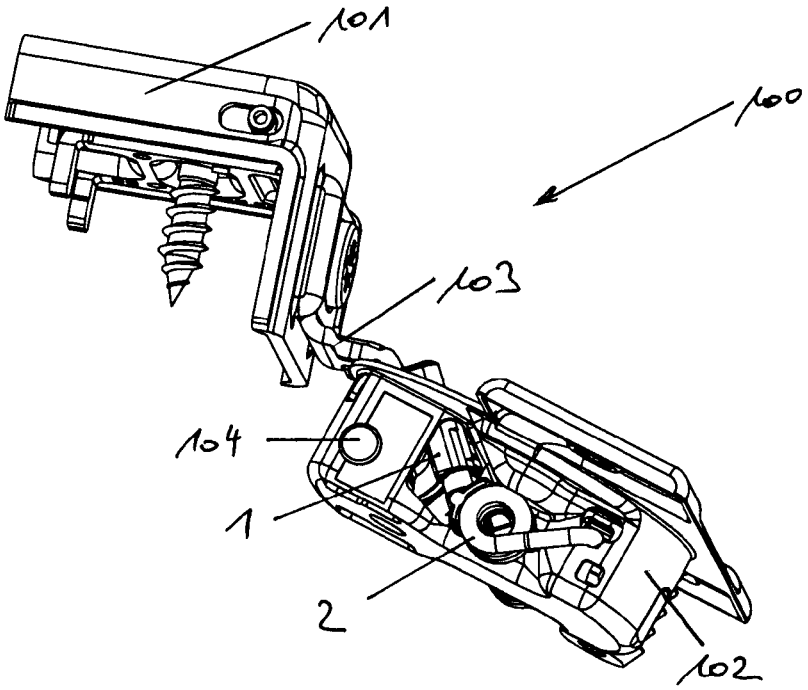
FIG. 7 is a perspective view of a furniture hinge.
Figure 8:
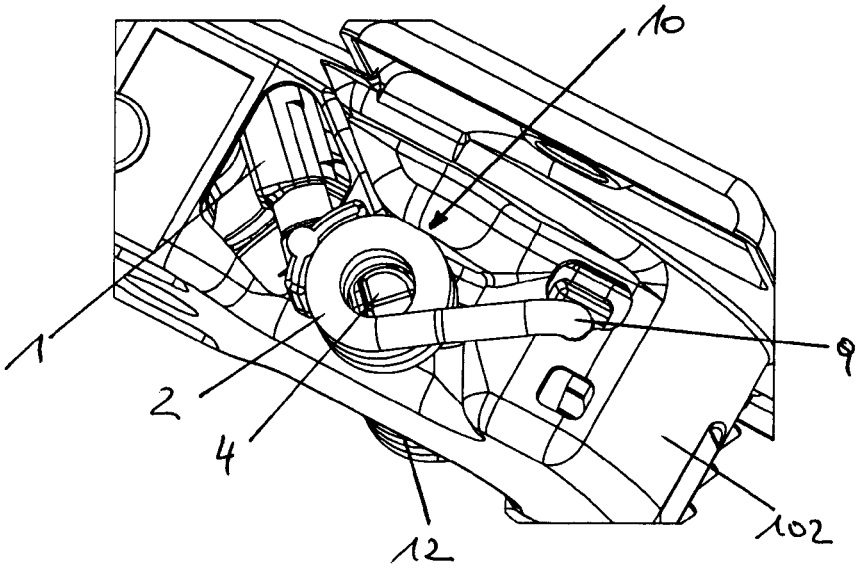
FIG. 8 is a detail view of the furniture hinge represented in FIG. 7.

The attachment of the two springs 2 and 12 in the furniture hinge 100 takes place in this preferred embodiment on the outside of the hinge cup 102 (see the description of the figures for FIGS. 7 and 8 in this connection).

Figure 3A:
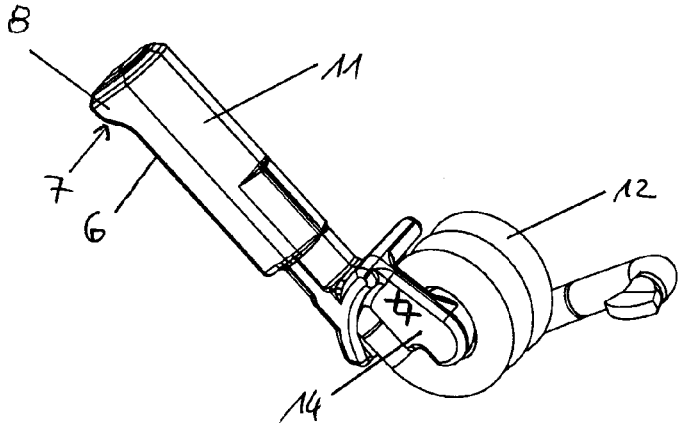

FIG. 3*a* is a detail representation of a spring 12 and a sliding element 11 attached to this spring 12 in perspective view. The sliding element 11 is connected, stationary, to the spring 12 via the attachment device 14. As can be clearly seen from this detail representation, the sliding element 11 has an outer contour 6 differing from the cylinder shape, in this case inter alia a projection 8, on which a control cam 7 is formed. The outer contour 6 preferably has a level surface (not shown) which corresponds (rides on) to the control cam 13 of the articulated lever 103.

In this preferred embodiment, the sliding element 11 is formed from a plastic—a thermoplastic such as polyoxymethylene (POM) is particularly preferred. The spring 12 is formed in this preferred embodiment from a metal—steel is particularly preferred.

Figure 3B:
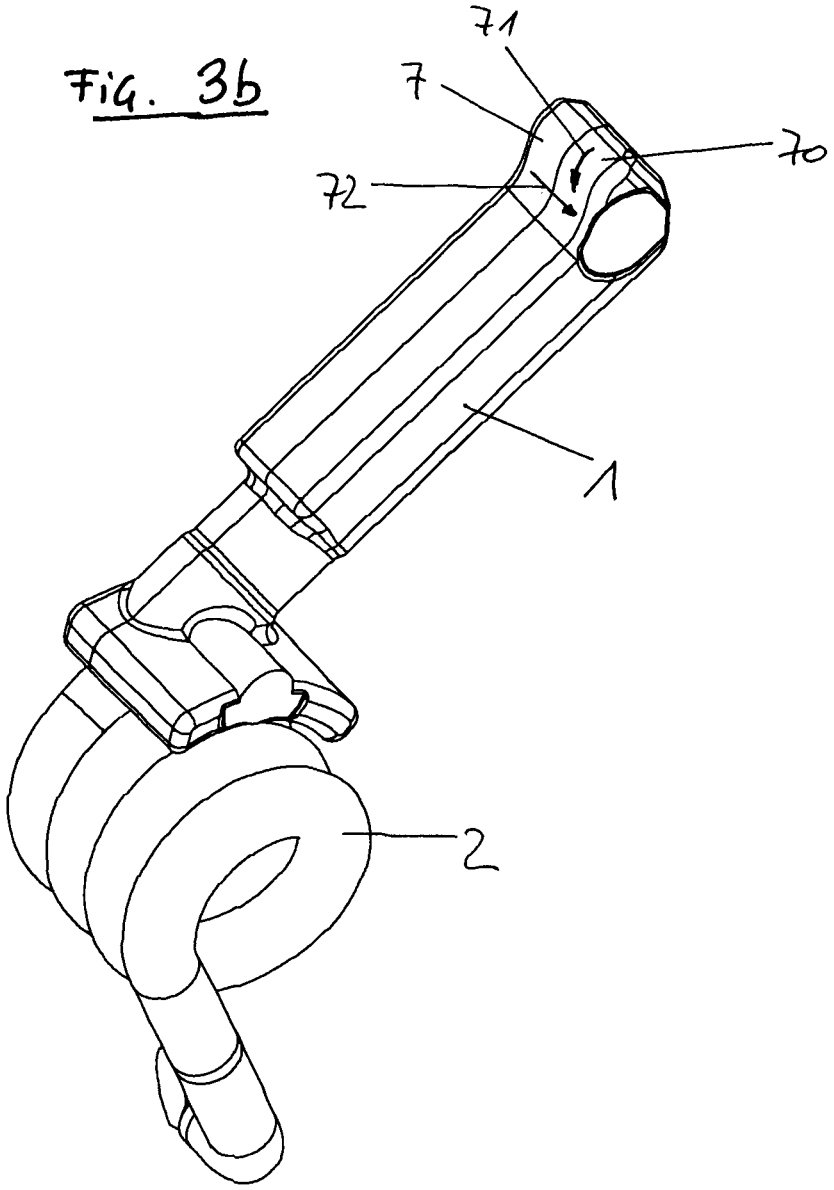

FIG. 3*b* shows, in perspective representation, a spring 2 to which a sliding element 1 is attached. The sliding element 1 has been pushed over the leg spring 2 provided with a circular cross-section and with coils.

The sliding element 1 has a control cam 7. This control cam 7 in turn has a curved plane 70, wherein this curved plane 70 is formed substantially straight in its transverse extension (axis) 72 and is formed curved in its longitudinal extension (axis) 71. It can thereby be achieved that the bearing surface of the sliding element 1 is not only supported at a point against a control cam, not shown here, of an articulated lever (likewise not shown), but a support at least along a line results. Point loads can thus be avoided.

FIG. 4 shows a top view of a furniture hinge 100 which has two sliding elements 1 and 11, which move along on the control cams 3 and 13 (not shown). The two sliding elements 1 and 11 are arranged on the springs 2 and 12 (not shown) in order to produce a closing force and/or opening force.

FIG. 5 shows a side representation of the furniture hinge 100 in the section of the furniture hinge of FIG. 4. The fitting 101 is connected to the hinge cup 102 via the articulated lever 103.

During the swiveling of the fitting 101 relative to the hinge cup 102, in this embodiment, the sliding element 1, together with the spring 2, moves along on the control cam 3.

In a detail view—represented in FIG. 6—it can be clearly seen that this sliding element 1 has an outer contour 6 differing from the cylinder shape, which is revealed by a further control cam 7 and the projection 8. The sliding element 1 is attached to the spring 2, and this sliding element 1 moves along on the control cam 3 in order to produce a closing force and/or opening force. Likewise, it would naturally also be conceivable that the control cam 3 is not formed on the articulated lever 103, as in this preferred embodiment, but that the sliding element 1 has the control cam 7 only in order to produce a closing and/or opening force. This control cam 7 would then naturally have another contour. In this embodiment, the sliding element 1 has a substantially cylindrical cavity, in which the spring 2, which has a substantially cylindrical cross-section at least at one end, is arranged.

FIG. 7 shows a further perspective representation of a furniture hinge 100, as just described. It can be clearly seen especially in the detail view of FIG. 8 that the spring 2 is preferably formed as a leg spring. A first end 9 of the spring 2 is attached to the hinge cup 102, and the coils of the leg spring 2 are supported on the support point 10 of the hinge cup 102. The support point 10 is formed as a contact surface for the coils of the spring 2. The above-mentioned likewise relates analogously to the spring 12 on the other side of the hinge cup 102.

FIG. 9 shows the perspective representation of a further embodiment of a furniture hinge 100 with sliding elements 21 and 31.

As shown in the detail representation of FIG. 10, the sliding element 21 has a cover 22 which can be formed detachable. Below the cover 22 there is a reservoir 5 in the sliding element 21 which serves to hold a lubricant, not shown. In this embodiment, the sliding element 21 is now connected, stationary, to the control cam 3. Over the whole life of the furniture hinge 100, the sliding element 21 dispenses the lubricant from its reservoir 5 at the bearing point between spring 2 and the control cam 3.

Figure 11A:
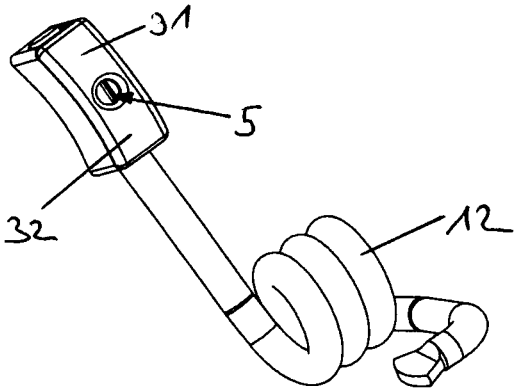

FIG. 11*a* shows a detail representation of the leg spring 12 and the sliding element 31 arranged thereon, which has a cover 32 below which there is a reservoir 5 for holding a lubricant.

Figure 11B:
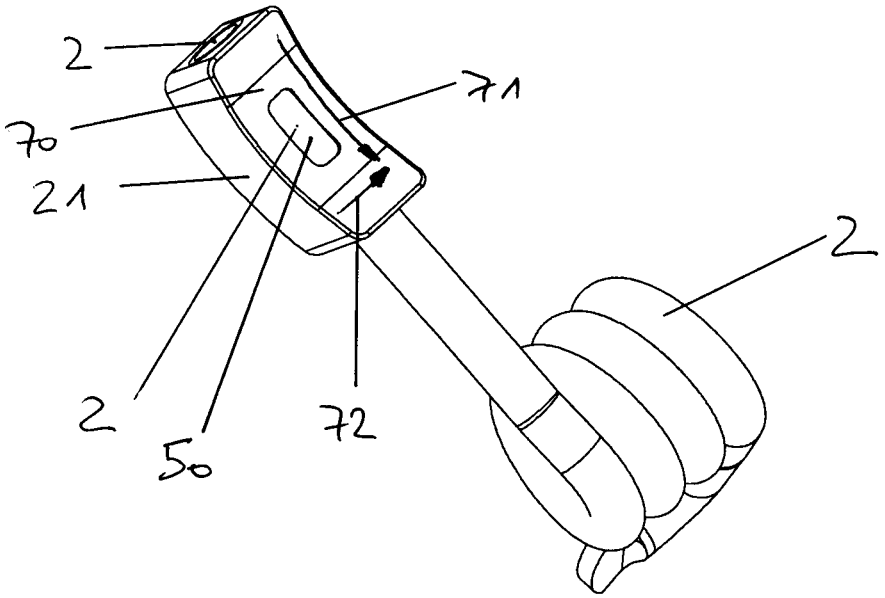

FIG. 11*b* shows a detail representation in perspective view of the spring 2 and a sliding element 21, arranged thereon. In this perspective bottom view of the sliding element 21 it can be clearly seen that the sliding element 21 has an opening 50 through which a lubricant can exit and thus likewise can contribute to a positive sliding behavior.

Likewise, this underside of the sliding element 21 is not formed flat, but the sliding element 21 has a curved plane 70, wherein the curved plane 70 is formed substantially straight in its transverse extension (axis) 72 and is formed curved in its longitudinal extension (axis) 71. In this representation, it can again be clearly seen that the spring 2 is formed as a leg spring and has a circular cross-section, whereby it is made easier to arrange the spring 2 on the sliding element 21.

Figure 12:
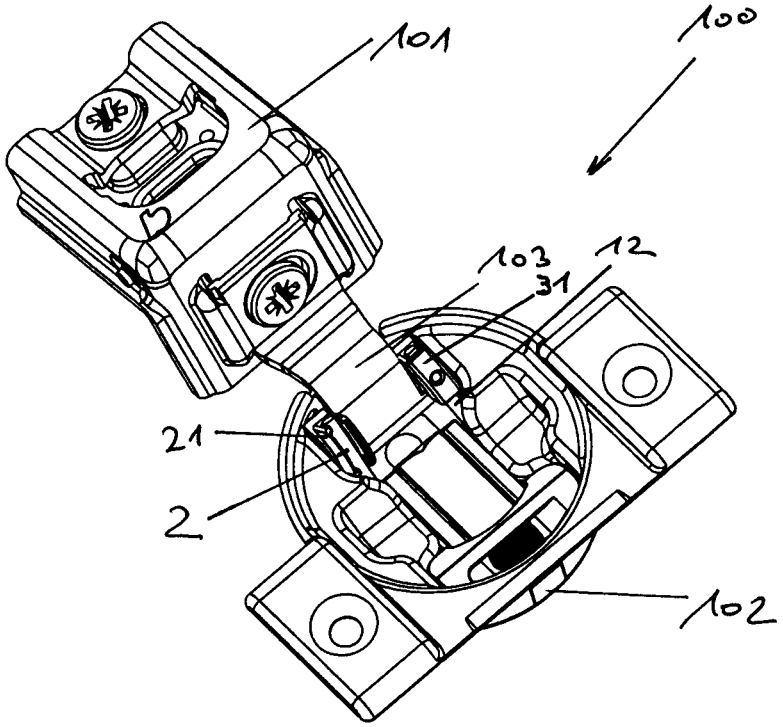
FIG. 12 is a perspective view of a furniture hinge, in which a cover has been removed from a sliding element.

FIG. 12 shows a further perspective representation of a furniture hinge 100 as just described in FIGS. 9, 10 and 11. In this representation, the sliding element 31 has a closed cover 32 and the sliding element 21 is represented without the cover 22.

During the swiveling of the fitting 101 relative to the hinge cup 102, in this embodiment, the spring 2 in the sliding element 1 moves along on the control cam 3.

Figure 13:
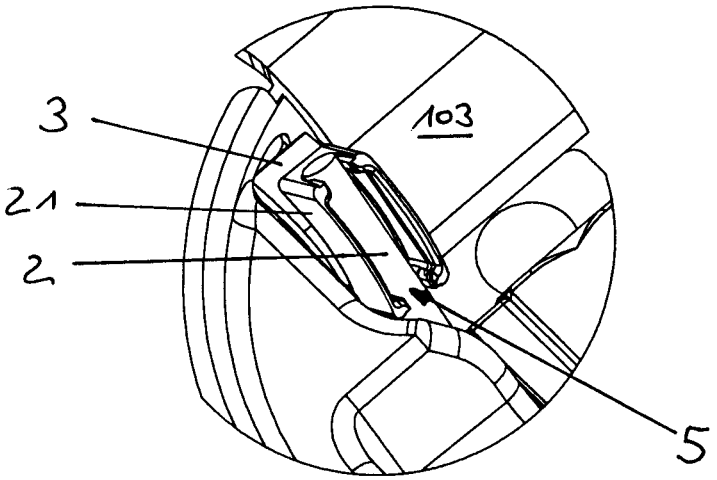
FIG. 13 is a detail view of the sliding element without cover as represented in FIG. 12.

The detail view of FIG. 13 shows the reservoir 5 which is located in the interior of the sliding element 21. This reservoir 5 can be filled with a lubricant (not shown) and then lubricates the bearing point between spring 2 and the control cam 3 of the articulated lever 103 of the furniture hinge 100.

Figure 14A:
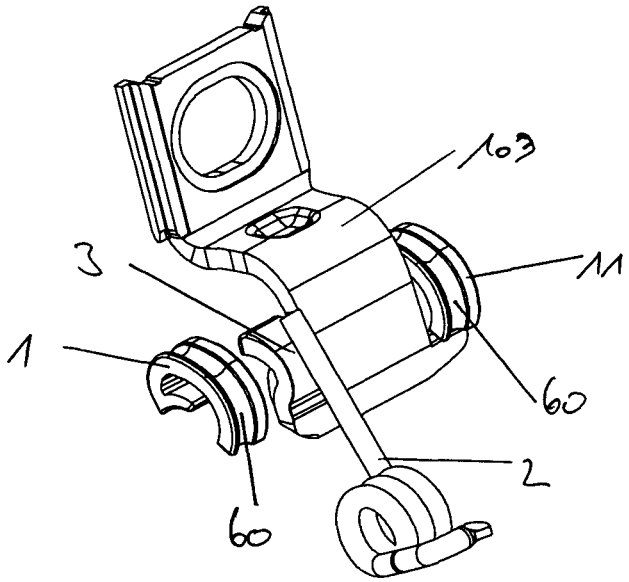
FIGS. 14*a* and 14*b* is an exploded representation of an articulated lever of a furniture hinge with sliding element and leg spring and of the articulated lever in perspective representation in the assembled state.

FIG. 14*a* shows the articulated lever 103 of a furniture hinge in perspective representation. The articulated lever 103 has, inter alia, the control cam 3. The sliding element 1 formed in one piece in this preferred embodiment can be pushed over this control cam 3 and thus be attached to the articulated lever 103.

Figure 14B:
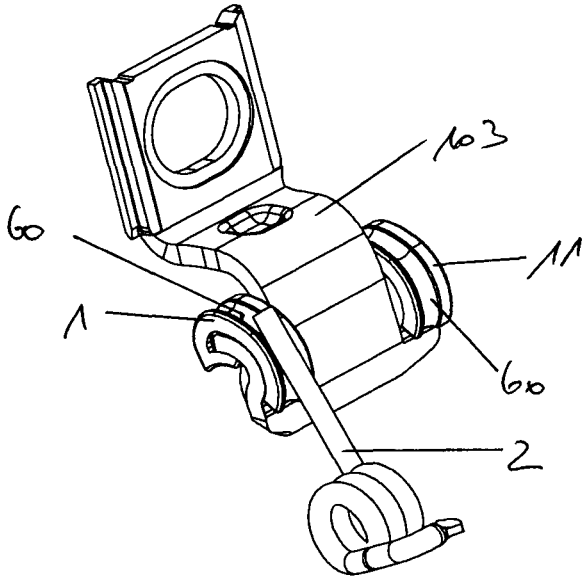

In this embodiment, the sliding element 1 has a channel-shaped groove 60 which is intended to hold the spring 2 (FIG. 14*b*). In order to obtain as large as possible a bearing surface or bearing line, the radius of this channel-shaped groove 60 roughly corresponds to the radius of the cross-section of the spring 2. For this, the spring 2 is preferably formed with a circular cross-section at least in its end areas.

In the exploded representation of FIG. 14*a*, it can furthermore be clearly seen that the sliding elements 1 and 11 are formed as separate assemblies. It is thereby made possible to also subsequently attach such a sliding element 1 and 11—to already existing furniture hinges. This results in the advantage that it is not absolutely necessary to replace the entire furniture hinge in case of need, but it is sufficient to retrofit existing furniture hinges with this sliding element 1 and 11. Naturally, it is likewise envisaged to produce new furniture hinges which have such sliding elements 1 and 11.

Figure 15:
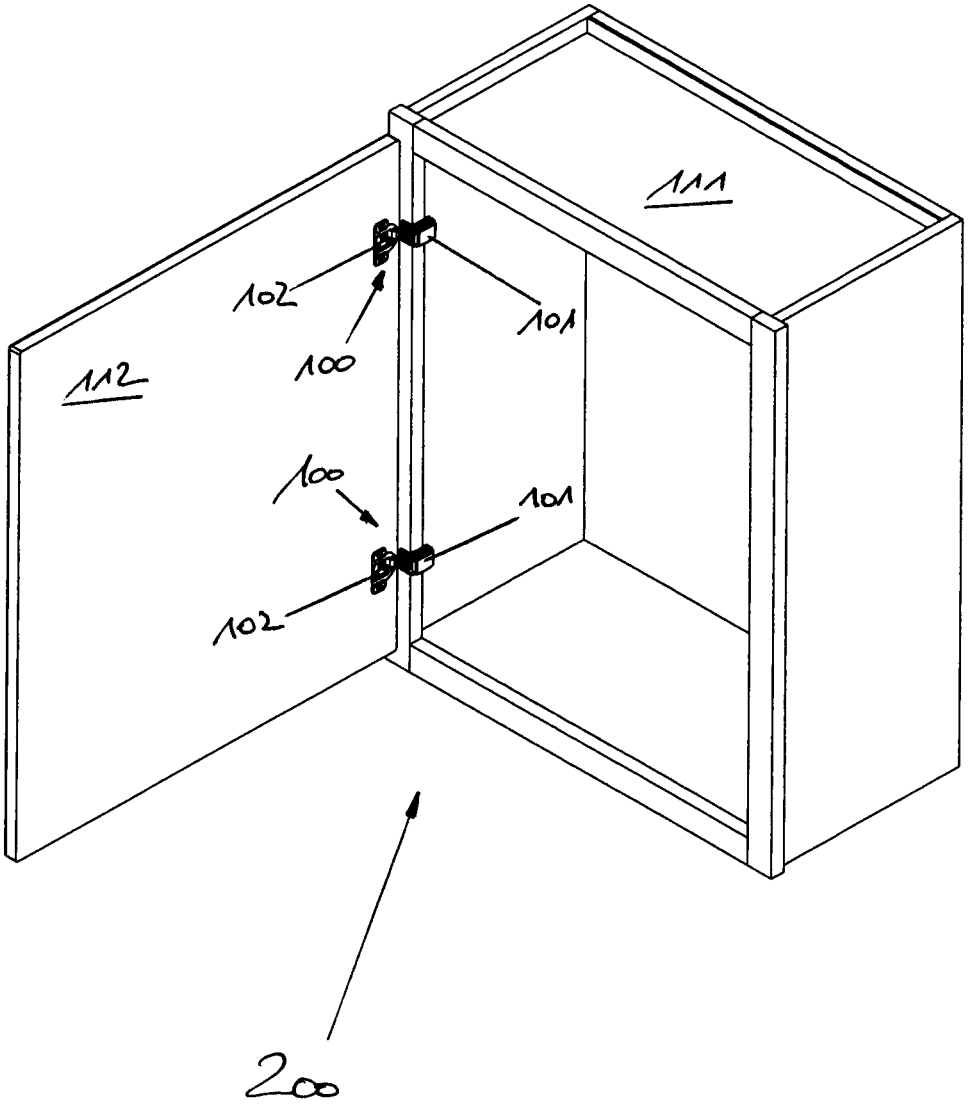
FIG. 15 shows a piece of furniture with two furniture hinges and a movable furniture part.

FIG. 15 shows a piece of furniture 200 with a movable furniture part 112 and a first furniture part 111 which is formed as a cabinet body.

The cabinet body 111 is connected to the movable furniture part 112 via two furniture hinges 100.

The furniture hinges 100 are attached to the first furniture part 111 with their fittings 101 and attached to the second, movable furniture part 112 with their hinge cups 102. The furniture part 112 is thereby movably mounted on the cabinet body 111.

Although the invention has been described specifically using the embodiments shown, it goes without saying that the subject-matter of the application is not limited to these embodiments. Rather, it goes without saying that measures and modifications that serve to implement the inventive idea are perfectly conceivable and desired. Thus, as already mentioned in the description of the figures, a sliding element could be used in hinges other than those shown—such as for instance in four-point hinges. It would likewise be conceivable that the control cams are formed, not on the articulated lever, but on the sliding element itself or also on the sliding element and on the articulated lever. Naturally, it would likewise also be conceivable that the control cam is formed on the spring.

The invention claimed is:

1. A furniture hinge device comprising:

a first fitting to be attached to a first furniture part;

a second fitting to be attached to a second furniture part;

a lever pivotally connecting said first fitting and said second fitting;

a control cam located on a first one of said first fitting, said second fitting, and said lever;

a leg spring attached to a second one of said first fitting, said second fitting, and said lever, said leg spring having a circular cross-section at least at a first end thereof; and a sliding element attached to said spring, said sliding element having a cylindrical cavity corresponding to said circular cross-section of said first end of said leg spring, said first end of said leg spring being received within said cylindrical cavity of said sliding element, an outer contour of said sliding element having a non-cylindrical shape;

wherein said control cam or said leg spring moves on said sliding element such that said control cam moves along said leg spring to produce a closing force or an opening force.

2. The furniture hinge device according to claim 1, wherein said control cam moves on said sliding element.

3. The furniture hinge device according to claim 1, wherein said leg spring moves on said sliding element.

4. The furniture hinge device according to claim 1, wherein one of said first fitting and said second fitting is a hinge cup swivellably connected to the other of said first fitting and said second fitting via said lever, and said control cam is formed on said lever.

5. The furniture hinge device according to claim 1, wherein said sliding element is pushed onto said leg spring or is attached to said control cam.

6. The furniture hinge device according to claim 1, wherein said sliding element is at least partially formed from plastic and/or said leg spring is formed from metal.

7. The furniture hinge device according to claim 6, wherein said plastic is polyoxymethylene (POM) thermoplastic.

8. The furniture hinge device according to claim 6, wherein said leg spring is formed from steel.

9. The furniture hinge device according to claim 6, wherein said sliding element is completely formed from said plastic.

10. The furniture hinge device according to claim 1, wherein said sliding element has at least one reservoir for storing a lubricant.

11. The furniture hinge device according to claim 1, wherein said sliding element has a control cam or a projection.

12. The furniture hinge device according to claim 1, wherein said sliding element has a curved plane, said curved plane being substantially straight in a transverse extension and curved in a longitudinal extension.

13. The furniture hinge device according to claim 1, wherein said sliding element is formed as a discrete component separate from said spring and said control cam.

14. The furniture hinge device according to claim 1, wherein said sliding element has a one-piece construction.

15. The furniture hinge device according to claim 1, wherein said sliding element is one of at least two sliding elements of said furniture hinge device.

16. A piece of furniture comprising:

a furniture body; and a movable furniture part;

wherein said movable furniture part is movably mounted to said furniture body via said furniture hinge device according to claim 1.

* * * * *